US010892566B2

(12) United States Patent
Jiang et al.

(10) Patent No.: US 10,892,566 B2
(45) Date of Patent: Jan. 12, 2021

(54) CONDUCTOR CONNECTION, CONNECTION PIECE AND METHOD FOR FABRICATING A CONDUCTOR CONNECTION

(71) Applicant: TDK Electronics AG, Munich (DE)

(72) Inventors: Yun Jiang, Neubiberg (DE); Karsten Frey, Giengen an der Brenz (DE); Klaus-Juergen Schmid, Giengen an der Brenz (DE)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 16/471,377

(22) PCT Filed: Dec. 11, 2017

(86) PCT No.: PCT/EP2017/082231

§ 371 (c)(1),
(2) Date: Jun. 19, 2019

(87) PCT Pub. No.: WO2018/114433

PCT Pub. Date: Jun. 28, 2018

(65) Prior Publication Data

US 2019/0312364 A1 Oct. 10, 2019

(30) Foreign Application Priority Data

Dec. 23, 2016 (DE) ..... 10 2016 125 647

(51) Int. Cl.

| | |
|---|---|
| ***H01R 4/00*** | (2006.01) |
| ***H01R 4/14*** | (2006.01) |
| ***H01R 4/02*** | (2006.01) |
| ***H01R 4/18*** | (2006.01) |
| ***H01R 43/02*** | (2006.01) |
| *H01R 4/12* | (2006.01) |

(52) U.S. Cl.

CPC ..... *H01R 4/14* (2013.01); *H01R 4/027* (2013.01); *H01R 4/18* (2013.01); *H01R 4/183* (2013.01); *H01R 43/0263* (2013.01); *H01R 4/12* (2013.01)

(58) Field of Classification Search

CPC ..... H01R 4/70; H01R 4/22; H02G 3/0418
USPC ..... 174/84 C, 84 R, 94 R, 87
See application file for complete search history.

(56) References Cited

U.S. PATENT DOCUMENTS

| | | | | |
|---|---|---|---|---|
| 3,649,743 A | | 3/1972 | O'Loughlin | |
| 4,195,401 A | * | 4/1980 | Galloup | H01R 43/0335 140/123 |
| 4,315,175 A | | 2/1982 | Hamilton et al. | |

(Continued)

FOREIGN PATENT DOCUMENTS

| | | |
|---|---|---|
| CN | 1510783 A | 7/2004 |
| CN | 103797648 A | 5/2014 |

(Continued)

*Primary Examiner* — Phuong Chi Thi Nguyen
(74) *Attorney, Agent, or Firm* — Slater Matsil, LLP

(57) ABSTRACT

A conductor connection, a connection piece and a method for fabricating a conductor connection are disclosed. In an embodiment a conductor connection includes a connection piece including one or more openings and a wall whose distance from a longitudinal axis of the connection piece increases toward at least one of the openings, and several electric conductors, wherein each of the electric conductors extends through one of the openings into the connection piece.

20 Claims, 4 Drawing Sheets

(56) References Cited

U.S. PATENT DOCUMENTS

| | | | |
|---|---|---|---|
| 4,442,316 | A | 4/1984 | Thuermer |
| 9,236,666 | B2 | 1/2016 | Matsushita |

FOREIGN PATENT DOCUMENTS

| | | | |
|---|---|---|---|
| CN | 205621866 | U | 10/2016 |
| DE | 3043209 | A1 | 6/1982 |
| DE | 19723663 | A1 | 12/1997 |
| GB | 816499 | A | 7/1959 |
| JP | S52005486 | A | 1/1977 |
| JP | 2007128800 | A | 5/2007 |
| JP | 2009252700 | A | 10/2009 |
| JP | 2015050082 | A | 3/2015 |
| WO | 2013039124 | A1 | 3/2013 |

* cited by examiner

CONDUCTOR CONNECTION, CONNECTION PIECE AND METHOD FOR FABRICATING A CONDUCTOR CONNECTION

This patent application is a national phase filing under section 371 of PCT/EP2017/082231, filed Dec. 11, 2017, which claims the priority of German patent application 102016125647.1, filed Dec. 23, 2016, each of which is incorporated herein by reference in its entirety.

TECHNICAL FIELD

The present invention relates to a conductor connection comprising several conductors fastened to each other. The conductors are, for example, a stranded wire, which is connected to a rigid connection element, such as a terminal pin. Such conductors are used, for example, in electrical components, especially inductive components.

BACKGROUND

Usually such conductors are electrically connected to each other by soldering or welding. Before fabricating the electrical connection, the conductors are mechanically secured to each other. In the case of a connection of a stranded wire to a terminal pin, the stranded wire is coiled around the terminal pin, for example. The fastening by coiling often does not provide adequate mechanical stability for the subsequent electrical connection. An additional mechanical fastening of the wires to each other is often time consuming and cost intensive.

SUMMARY OF THE INVENTION

Embodiments of the invention provide a conductor connection and a connection piece with improved properties.

According to a first embodiment of the present invention, a conductor connection is disclosed, having a connection piece and several electric conductors. The conductor connection is, for example, part of a component. For example, the component is an inductance.

The connection piece has one or more openings. In particular, the connection piece has two openings. The conductors extend respectively through one of the openings into the connection piece. The conductors are fastened to each other by the connection piece. In particular, the connection piece produces a press fit for the conductors. Such a connection may also be called a crimp connection.

In particular, the connection piece is a so-called "splice crimp". The connection piece here is designed as a metallic strip part bent around the conductors. In order to produce the conductor connection and the shape of the connection piece, the metallic strip part is bent around the conductors arranged against each other. The strip part is press against the conductors.

The connection piece receives its shape, especially a sleeve shape, only upon being formed around the conductors. The strip part is, for example, flat in configuration before the bending process. After the shaping process, side regions of the strip part may overlap. By the overlapping of the side regions, such a connection piece can be distinguished from a prefabricated sleeve, such as a cable shoe.

The connection piece comprises a wall wherein the distance of the wall from a longitudinal axis of the connection piece increases toward the opening. The increasing distance of the wall toward the opening is present at least in one longitudinal section of the connection piece. The increasing distance of the wall may also be circumferential.

For example, a diameter and/or cross section of the connection piece also increases toward the opening. The increasing diameter is present at least in one longitudinal section of the connection piece. The connection piece may also have an increasing diameter circumferentially.

The connection piece has, for example, one opening region which converges in the opening, wherein the distance between the wall and a longitudinal axis increases in the opening region. The connection piece, for example, has a flat region, in which the distance between the wall and the longitudinal axis remains the same. In particular, the diameter and/or cross section remains the same in the flat region.

The connection piece has a concave shape, for example, in the region of the opening, especially in the opening region. In particular, a contour line of the connection piece has a concave profile. By a contour line is meant the profile of the wall of the connection piece in a longitudinal section. For example, the connection piece has a trumpet shape in the region of the opening.

Alternatively, the connection piece may have a cylindrical shape, for example, in the region of the opening, especially in the opening region. In particular, a contour line has a linear profile.

By such a shape of the connection piece in the region of the opening, the mechanical and thermomechanical stress on the conductors can be reduced. This is especially the case when the shape of the connection piece in the region of the opening is adapted to the profile of at least one of the conductors. In this way, a rubbing of the connection piece against the conductor or a notching of the conductor by the connection piece and hence a mechanical damage can be avoided.

For example, at least one of the conductors is led away from the longitudinal axis of the connection piece in the region of the opening. For example, the conductor in the region of the opening runs at an angle to the longitudinal axis. In particular, in the region of the opening the distance between the conductor and a longitudinal axis of the connection piece is greater than or equal to the distance between the wall and the longitudinal axis in the flat region. In the case of an entirely flat connection piece, there would be a danger of mechanical damage to the conductor by the connection piece here.

In one embodiment, at least one of the conductors has a mechanical flexibility. For example, at least one of the conductors is formed as a wire, especially a stranded wire. For example, the stranded wire is led away from the longitudinal axis of the connection piece in the region of the opening.

For example, at least one of the conductors is designed as a rigid connection element. This may be, in particular, a terminal pin. The connection element, for example, also runs parallel to the longitudinal axis of the connection piece in the region of the opening.

For example, one of the conductors is coiled around another of the conductors in the region of the connection piece. The coiling enables a defined arrangement of the conductors relative to each other while the connection piece is put in place.

In one embodiment, the connection piece connects a stranded wire to a rigid connection element, especially a terminal pin. The stranded wire may be coiled around the terminal pin in the region of the conductor connection.

The conductors have a respective free end. At the free end, the respective conductor is sliced off, for example. The free ends protrude, for example, from one of the openings or are arranged within the connection piece. For example, the free ends are arranged in the region of the same opening. In such an embodiment, the free ends can also be soldered together especially well.

Each of the conductors is, for example, part of a component or connected to a component. In particular, the conductors can be connected to a functional piece of a component. This might be an inductance, for example. The conductors, for example, extend respectively from the component or functional piece through one of the openings into the connection piece. The conductors may extend into the same opening or into different openings.

In one embodiment, the connection piece has two openings, wherein the distance between the wall and the longitudinal axis increases toward both openings. In particular, the diameter and/or cross section of the connection piece may increase toward both openings. The connection piece may be configured as described above in the region of each of the openings. For example, the connection piece may have a cylindrical shape or a trumpet shape in the region of both of the openings.

The connection piece, for example, has two opening regions, which respectively converge into one of the openings. Between the opening regions there may be formed a flat region. In the opening regions, the distance between the wall and the longitudinal axis increases toward the opening. In the flat region, the distance of the wall is constant. The opening regions may be identical or different in configuration.

Such a shape of the connection piece is especially favorable, for example, for the connection of conductors in which at least one of the conductors is led away from the longitudinal axis in the region of each opening.

In one embodiment, the connection of the conductor is produced solely by the connection piece. In an alternative embodiment, the conductors may additionally be soldered together. The conductors in one embodiment may also be additionally welded together. For example, a mechanical fastening of the conductors to each other is produced by the connection piece and the electrical connection is produced by additional soldering or welding. The soldering or welding may furthermore also strengthen the mechanical connection.

According to another embodiment of the invention, a component is disclosed with the above described conductor connection. In particular, this involves an electrical component, such as an inductance.

The component has, for example, a functional piece, from which at least one of the conductors extends into an opening of the connection piece. This opening, for example, is the opening toward which the distance between the wall and the longitudinal axis increases. For example, the conductors may both extend into this same opening, arriving from the functional piece.

According to another embodiment of the invention, a connection piece is disclosed for the connecting of two electrical conductors. The connection piece may have all of the structural and functional properties of the above described connection piece.

The connection piece in particular is formed as a bent metallic strip part ("splice crimp"), in which side regions of the strip overlap. The overlapping side regions lie tightly against each other, at least for a portion. The connection piece has two openings at opposite end faces, wherein the distance between the wall of the connection piece and a longitudinal axis of the connection piece increases toward at least one opening.

According to another embodiment of the present invention, a method is disclosed for fabricating the above described conductor connection and/or the above described connection piece.

In the method, a flat metallic strip part is provided. The strip part is severed, for example, from a longer strip. Two conductors arranged against each other are provided. For example, one of the conductors is coiled around the other conductor at least for a portion. The conductors may also simply lie against each other, for example.

The strip part is bent around the two conductors, so that the described conductor connection and/or the connection piece is obtained. In this way, a press fit of the conductors by the connection piece is obtained. After this, the conductors are separated, for example, in the region of one of the openings.

The conductor connection may have a sufficient mechanical strength, so that no further connection technique is required. Alternatively, an additional electrical and/or mechanical connection can occur after making the press fit. Such an additional connection is done, for example, by soldering or by welding. The additional connection is produced, for example, in the region of the sliced-off ends of the conductors.

In the present disclosure, several embodiments of an invention are described. All properties which are disclosed with regard to the connection piece, the component or the method are also disclosed accordingly in regard to the other aspects, even if the respective property is not explicitly mentioned in the context of the other aspects.

Furthermore, the specification of the subjects disclosed here is not confined to the individual special embodiments. Instead, the features of the individual embodiments—insofar as is technically feasible—can be combined with each other.

BRIEF DESCRIPTION OF THE DRAWINGS

In the following, the subjects specified here is explained more closely with the aid of schematic exemplary embodiments.

There are shown.

Preferably, the same reference symbols in the following figures refer to functionally or structurally corresponding parts of the different embodiments.

DETAILED DESCRIPTION OF ILLUSTRATIVE EMBODIMENTS

Figure 1:
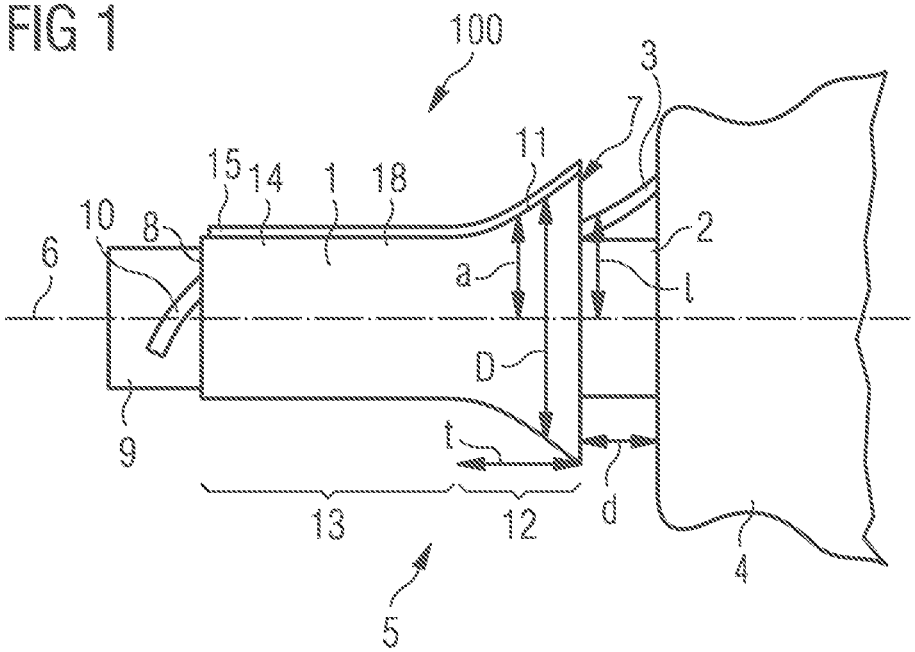
FIG. 1 shows an embodiment of a conductor connection and a connection piece in a schematic side view.

FIG. 1 shows a conductor connection 100 having a connection piece 1 for connecting of several electrical conductors 2, 3. The connection piece 1 is bent around the conductors 2, 3 and constitutes a press fit of the conductors 2, 3.

The conductor connection 100 is part of an electrical component 5. One or both of the conductors 2, 3 are led from a functional piece 4 of the electrical component 5 to the connection piece 1. The functional piece 4 may be, for example, an electrical functional piece of a component, such as an inductance, or a mechanical functional piece, such as a substrate.

The connection piece 1 is designed as a metallic strip part 18 bent around a longitudinal axis 6. The longitudinal axis 6 is a central axis in the longitudinal direction of the connection piece 1. The longitudinal axis 6 may represent an axis of symmetry of the connection piece 1. The longitudinal axis 6 corresponds, for example, to a longitudinal axis of the conductors 2, 3.

In order to make the connection, a flat strip part is sliced off from a metal strip, bent around the conductors 2, 3, and pressed against the conductors 2, 3. This method is explained in detail in connection with FIG. 6.

The conductors 2, 3 are thus joined mechanically to each other by the connection piece 1. The connection can have adequate stability, so that no soldering or other further connection technique is required. Alternatively, the conductors 2, 3 connected to the connection piece 1 can be additionally joined together by soldering and/or welding. The connection by means of a connection piece 1 is, for example, easier to produce and more reliable than the connection by means of an additional wire, which is coiled around the conductors 2, 3.

Such a connection piece 1 is usually called a "splice crimp". The connection piece 1 differs from a prefabricated sleeve in which one or more conductors are inserted. The present connection piece 1 is given its sleeve shape only during the forming around the conductors 2, 3. Thus, the conductors 2, 3 are not shoved into the connection piece 1. The connection piece 1 is not formed as a single piece with any of the conductors 2, 3.

The connection piece 1 comprises, as its material, for example copper, brass, bronze or other copper alloys.

The first conductor 2 is, for example, a rigid connection element. For example, it is a terminal pin. The second conductor 3 is, for example, a bendable wire, such as a stranded wire. The stranded wire may comprise copper. The stranded wire comprises, for example, 2 to 5000 individual wires. The second conductor 3 is coiled, for example, at least for a portion around the first conductor 2.

Alternatively, both conductors 2, 3 may also be the same kind of conductor. Furthermore, more than two conductors 2, 3 may also be joined by the connection piece 1. For example, several stranded wires and a terminal pin are joined together.

The conductors 2, 3 are led, for example, from a functional element 4 of the component 5 into the connection piece 1. The conductors 2, 3 each have one free end 9, 10, for example.

The connection piece 1 has two openings 7, 8. The openings 7, 8 are formed at opposite end faces of the connection piece 1. In at least one of the openings 7, 8, at least one of the conductors 2, 3 is led into and/or out from the connection piece 1.

In the embodiment shown, each conductor 2, 3 extends from the functional element 4 at first into the first opening 7. But it may also be the case that the conductors 2, 3 extend from different openings into the connection piece 1. For example, the first conductor 2 extends from the functional element 4 into the first opening 7 and the second conductor 3 extends, e.g., from a further functional element (not depicted), through the second opening 8.

In the present instance, both free ends 9, 10 extend through the second opening 8 and out from the connection piece 1. One or both free ends 9, 10 may also lie within the connection piece 1. Furthermore, one or both free ends 9, 10 may also protrude from the first opening 7, through which the conductors 2, 3 reach into the connection piece 1. For example, the second conductor 3 reaches through the first opening 7 into the connection piece 1 and is bent around such that its free end 9 again emerges from the first opening 7.

The connection piece 1 has a wall 11, whose distance a from the longitudinal axis 6 increases in the direction of the first opening 7. Accordingly, the contour of the wall 11 in longitudinal section leads away from the longitudinal axis 6 in the direction of the first opening 7. The connection piece 1 may also have the increasing distance a of the wall 11 in the circumferential direction.

For example, the diameter D of the connection piece 1 increases in the direction of the first opening 7. The connection piece 1, for example, has its largest diameter at the first opening 7. The cross section of the connection piece 1 also increases, for example, in the direction of the first opening 7.

The connection piece 1 has, for example, a first opening region 12 in which the contour profile of the wall 11 leading away from the longitudinal axis 6 is present. Furthermore, the connection piece 1 has a flat region 13, in which the distance a between the wall 11 and the longitudinal axis 6 remains the same.

Due to the increase in the distance between the wall 11 and the longitudinal axis 6, the mechanical stress on the conductors 2, 3 can be reduced and thus a damaging of the conductors 2, 3 can be prevented. The contour of the wall 11 of the connection piece 1 is adapted, for example, to the profile of the second conductor 3. The opening region 12 is thus not formed as an inserting aid, but rather configured to prevent mechanical damage.

This is especially advantageous in the case of a conductor 3 which is led away from the longitudinal axis 6 in the region of the first opening 7. The main direction of extension of the conductor 3 runs here at an angle to the longitudinal axis 6 in the region of the opening 7. The conductor 3, for example, is also led away from the first conductor 2, which runs parallel to the longitudinal axis. The main directions of extension of the conductors 2, 3 thus do not run parallel, at least in the region of the first opening 7.

In particular, the distance 1 between the second conductor 3 and the longitudinal axis 6 increases toward the outside in the region of the opening 7. The distance 1 in the region of the opening 7 may be, for example, equal to or greater than the distance of the wall 11 in the flat region 13.

The functional element 4 has, for example, only a slight distance from the connection piece 1. Thus, only a narrow gap is present between the connection piece 1 and the functional element 4. For example, the distance d between the functional element 4 and the connection piece 1 is less than or equal to 1 mm. In this case, the mechanical stress on a conductor 3 leading away from the longitudinal axis is especially large. By the adapted contour of the wall 11 of the connection piece 1, damage is prevented. This may also allow a use of the component 5 at higher temperatures, for example.

On the whole, the connection piece 1 has an extension along the longitudinal axis 6 of at most 30 mm, for example. The extension along the longitudinal axis 6 is, for example, at least 1.5 mm. The first opening region 12 has, for example, an extension t along the longitudinal axis 6 of 0.15% to 0.5% of the extension of the connection piece 1.

The contour of the wall 11 is concave in configuration, for example. The angle between the contour line of the wall 11 and the longitudinal axis 6 increases toward the opening 7, for example. The connection piece 1 has the shape of a trumpet, for example, at least in the region of the opening 7.

Alternatively, the contour of the wall 11 may also run linearly. In this case, the contour line of the wall 11 runs at a fixed angle to the longitudinal axis 6. For example, the connection piece 1 has the shape of a cylinder at least in the region of the opening 7.

Instead of the first opening 7, the second opening 8 may also have a contour of the wall 11 leading away from the longitudinal axis 6. Furthermore, it may also be provided that both openings 7, 8 have a contour of the wall 11 leading away from the longitudinal axis 6. This is especially advantageous when conductors protrude from both openings 7, 8 and are led away from the longitudinal axis 6. Furthermore, when both openings 7, 8 are configured with a contour of the wall 11 leading away from the longitudinal axis 6, the connection piece 1 may have a symmetrical configuration, which simplifies the production of the connection piece 1 and enables a more flexible usage.

The connection piece 1 has two side regions 14, 15 which overlap. In particular, the regions 14, 15 overlap in a direction perpendicular to the longitudinal axis 6, so that the second region 15 here is arranged on top of the first region 14. The overlapping extends, for example, in the longitudinal direction along the entire connection piece 1. A connection piece 1 with such overlapping regions can be easily distinguished from a preshaped sleeve.

The overlapping regions 14, 15 of the connection piece 1 in the present instance lie tightly against each other. This holds in particular for the flat region 13 of the connection piece 1. In the opening region 12, a close abutment of the overlapping regions 14, 15 is not present in every instance, as can be seen, e.g., from FIG. 2.

Figure 2:
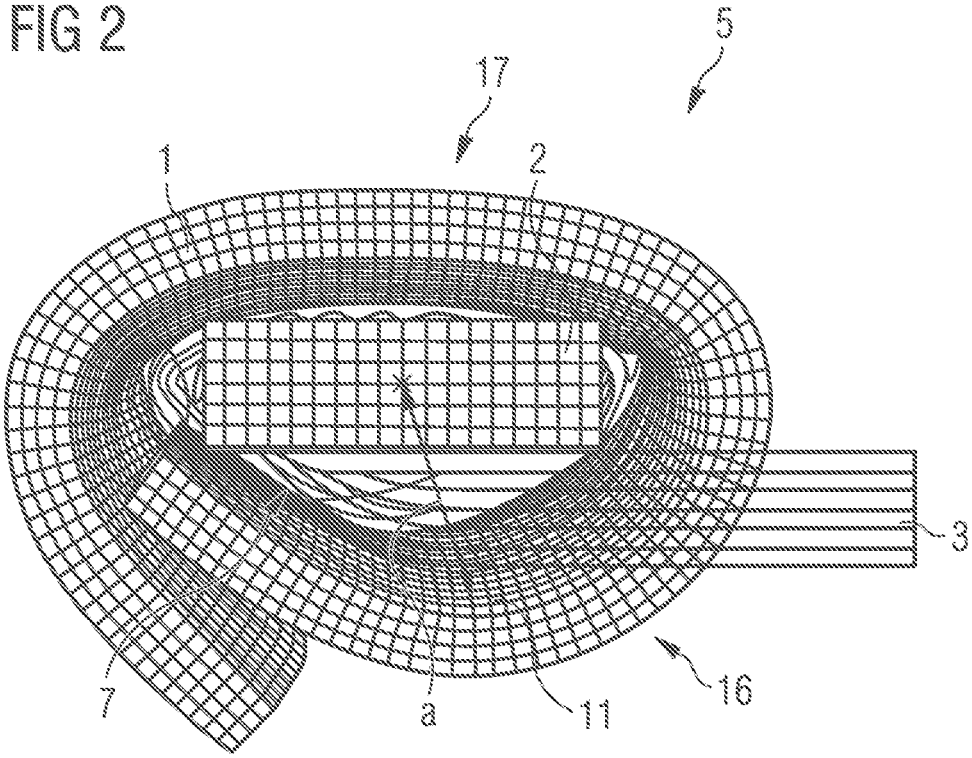
FIG. 2 shows an embodiment of a conductor connection and a connection piece in a front view.

FIG. 2 shows a connection piece 1 and two conductors 2, 3 connected to it in front view. In particular, this is a view of an end face of the connection piece 1. For example, it is an embodiment similar or equal to the embodiment of FIG. 1.

The connection piece 1 has a contour of the wall 11 leading away from the longitudinal axis 6, for example, in a region 16 in which the second conductor 3 is introduced into the opening 7. In another region 17, which, for example, is situated opposite the region 16, looking from the first conductor 2, the connection piece 1 may have a different contour. For example, the contour of the wall 11 there runs parallel to the longitudinal axis 6.

Figure 3:
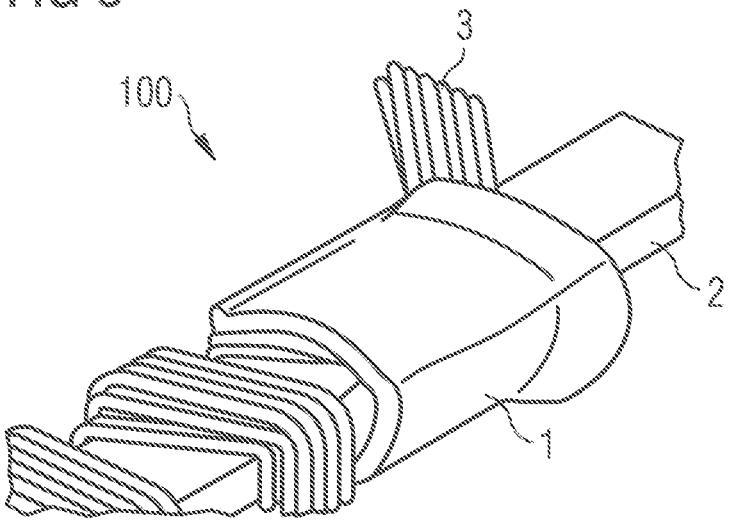
FIGS. 3 and 4 show the embodiment of FIG. 2 in perspective views.
Figure 4:
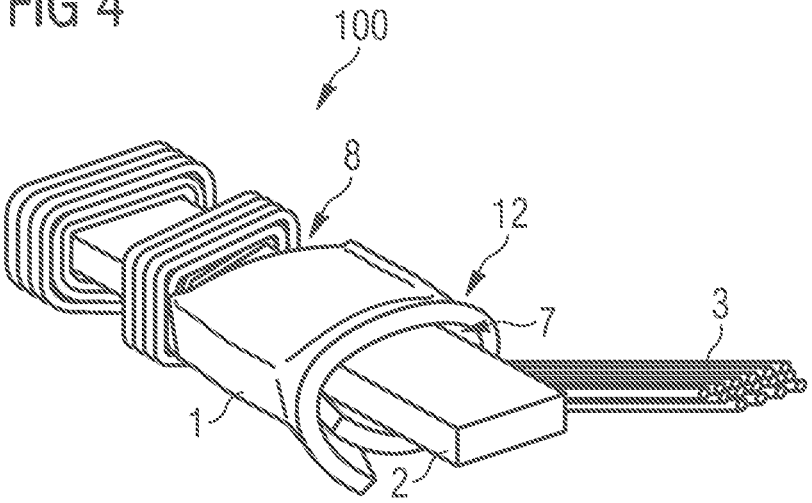

FIGS. 3 and 4 show the connection piece 1 and the conductors 2, 3 connected to it of FIG. 2 in various perspective views.

The flexible first conductor 3 is partly coiled around the rigid second conductor 2. The conductor 3 extends, for example, from a functional element 4 into the first opening 7 and out from the second opening 8. Beyond the second opening 8, the first conductor 3 is bent around, for example, and reaches through the second opening 8 into the connection piece 1 once again. The end of the second conductor 3 is situated in the connection piece 1.

Figure 5:
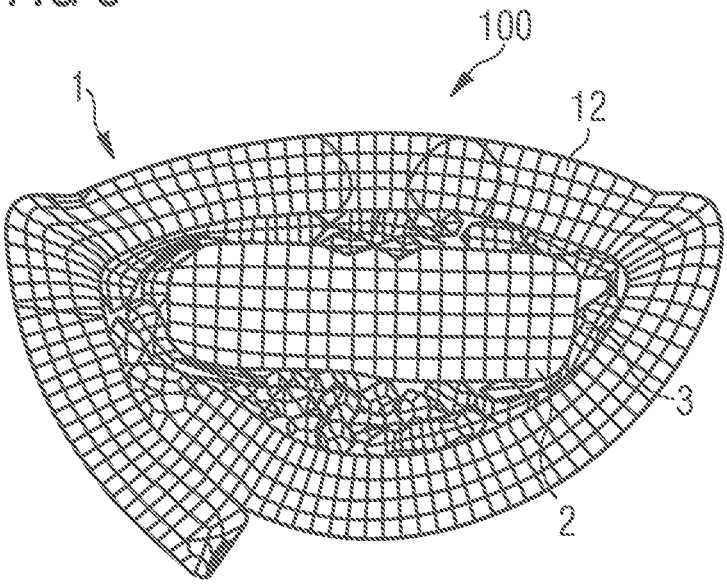
FIG. 5 shows the embodiment of FIGS. 2 to 4 in a cross sectional view.

FIG. 5 shows the embodiment of FIGS. 2 to 4 in a view looking at the opening region 12 of the connection piece 1.

In particular, the conductors 2, 3 here can be seen inside the connection piece 1. The conductors 2, 3 are pressed against each other. The flexible conductor 3 is partly deformed on account of the pressing. In particular, stranded wires of the flexible conductor 3 are deformed.

Figure 6:
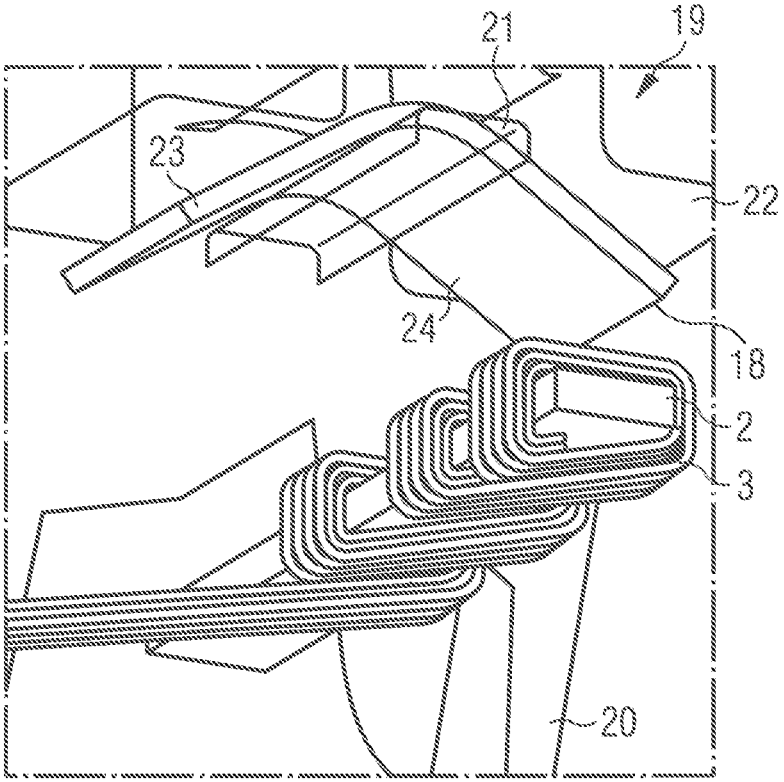
FIG. 6 shows one step in the method for fabricating a conductor connection and a connection piece.

FIG. 6 shows a step of the method in the fabrication of the conductor connection 100 according to FIGS. 1 to 5. In the method, the connection piece 1 is bent by means of a shaping device 19 around the conductors 2, 3.

The conductors 2, 3 being connected are arranged against each other. For example, the second conductor 3 is coiled around the first conductor 2. The mutually abutting conductors 2, 3 are placed in a holding part 20 of the shaping device 19.

A metallic strip part 18 is provided. The strip part 18 at the beginning of the method is configured flat, for example. The strip part 18 is severed from a longer strip, such as a roll. The strip part 18 is placed in a further holding part 21 of the shaping device 19.

The shaping device 19 has one or more movable shaping parts 22, especially movable punches. The shaping parts 22 are moved up to the metal piece 18 and press side regions of the metal piece 18 downward. Thus, the side regions are laid around the conductors 2, 3.

The shaping parts 22, for example, do not extend along a region 23 of the metal piece 18 from which the opening region 12 with the wall 11 contour leading away from the longitudinal axis is formed (see FIG. 1). In this way, the described contour is formed by the lack of action of the shaping parts 22. The shaping parts 22 act on a region 24 from which the flat region 13 is formed (see FIG. 1).

The shaping device 19 may have further movable parts for the shaping of the strip part 18 and for making the press fit. The shaping parts 22 may also be led around the conductors 2, 3.

The conductors 2, 3 after the connecting by the connection piece 1 may be sliced off beyond one of the openings 7, 8, especially beyond the second opening 8. The conductors 2, 3 then have non-insulated ends, well suited to a soldering. This facilitates and shortens the soldering process. Furthermore, solder bridges are avoided.

Alternatively, no additional connection is made after the connecting, in particular, no soldered or welded connection, so that the conductors 2, 3 are joined together solely by the connection piece 1.

Figure 7:
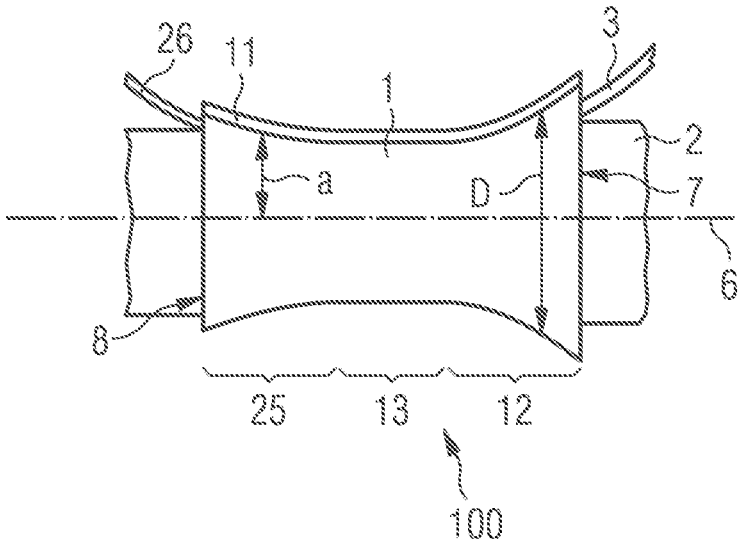
FIG. 7 shows another embodiment of a connection piece in a schematic side view.

FIG. 7 shows another embodiment of a conductor connection 100 with a connection piece 1 in schematic side view.

The connection piece 1, unlike the connection piece 1 of FIGS. 2 to 5, has two opening regions 12, 25, in which the distance a between the wall 11 and the longitudinal axis 6 increases toward the respective opening 12, 25. In particular, the cross section of the connection piece 1 increases toward both openings 7, 8.

This is especially advantageous for the case when conductors 3, 26 leading away from the longitudinal axis 6 toward the outside protrude from both openings 7, 8. This may be the same conductor or two different conductors. For example, the conductors 3, 26 may be two flexible conductors, especially stranded wires, which are connected by the connection piece 1 to a rigid conductor 2.

The invention claimed is:

1. A conductor connection comprising:

a connection piece configured to mechanically connect several electric conductors to each other, the connection piece comprising:

one or more openings; and a wall whose distance from a longitudinal axis of the connection piece increases toward at least one of the openings; and the several electric conductors, wherein each of the electric conductors extends through one of the openings into the connection piece, wherein the electrical conductors are mechanically connected to each other by a press-fit connection formed by the connection piece, wherein the connection piece is a metallic strip part bent around the electric conductors, and wherein side regions of the strip part overlap.

2. The conductor connection according to claim 1, wherein at least one of the electric conductors is a rigid connection element.

3. The conductor connection according to claim 1, wherein the overlapping side regions lie tightly against each other, at least for a portion.

4. The conductor connection according to claim 1, wherein the connection piece has a cylindrical shape in a region of the opening.

5. The conductor connection according to claim 1, wherein the connection piece has a trumpet shape in a region of the opening.

6. The conductor connection according to claim 1, wherein a profile of the wall in a region of the opening is adapted to a profile of at least one of the electric conductors.

7. The conductor connection according to claim 1, wherein at least one of the electric conductors is led away from the longitudinal axis in a region of the opening.

8. The conductor connection according to claim 1, wherein at least one of the electric conductors is a stranded wire.

9. The conductor connection according to claim 1, wherein the connection piece has two openings, and wherein the distance between the wall and the longitudinal axis increases toward each opening.

10. The conductor connection according to claim 1, wherein each electric conductor has a free end, and wherein the free ends are arranged at the same opening of the connection piece.

11. The conductor connection according to claim 1, wherein the connection piece has at least one opening region and a flat region, wherein the distance between the wall and the longitudinal axis increases toward the opening in the opening region, and wherein the distance between the wall and the longitudinal axis remains the same in the flat region.

12. The conductor connection according to claim 11, wherein, in the opening region, the distance between at least one of the electric conductors and the longitudinal axis is greater than or equal to the distance between the wall and the longitudinal axis in the flat region.

13. A method for fabricating a conductor connection, wherein the conductor connection comprises a connection piece for mechanically connecting several electric conductors to each other, wherein the connection piece includes one or more openings and a wall whose distance from a longitudinal axis of the connection piece increases toward at least one of the openings; and the several electric conductors, and wherein each of the electric conductors extends through one of the openings into the connection piece, the method comprising:

providing a flat strip part;

providing two conductors arranged against each other;

bending the strip part around the two conductors to fabricate the conductor connection such that side regions of the strip part overlap; and mechanically connecting the electrical conductors to each other by forming a press-fit connection by the connection piece.

14. The method according to claim 13, wherein at least one of the electric conductors is a rigid connection element.

15. The method according to claim 13, wherein the overlapping side regions lie tightly against each other, at least for a portion.

16. A component comprising:

a conductor connection, the conductor connection comprising:

a connection piece configured to mechanically connect several electric conductors to each other, the connection piece comprising:

one or more openings; and a wall whose distance from a longitudinal axis of the connection piece increases toward at least one of the openings; and the several electric conductors, wherein each of the electric conductors extends through one of the openings into the connection piece, wherein the electrical conductors are mechanically connected to each other by a press-fit connection formed by the connection piece, wherein the connection piece is a metallic strip part bent around the electric conductors, and wherein side regions of the strip part overlap; and a functional piece, from which at least one of the electric conductors extends into the opening of the connection piece, wherein the distance of the wall increases toward this opening.

17. The component according to claim 16, wherein the functional piece is an electrical functional piece.

18. The component according to claim 17, wherein the electrical functional piece is an inductance.

19. The component according to claim 16, wherein the functional piece is a mechanical functional piece.

20. The component according to claim 19, wherein the mechanical functional piece is a substrate.

* * * * *